US006518865B1

(12) United States Patent
Al-Hosini et al.

(10) Patent No.: US 6,518,865 B1
(45) Date of Patent: Feb. 11, 2003

(54) ELECTRIC SWITCHING DEVICE

(75) Inventors: Falah Al-Hosini, Västerås (SE); Stefan Valdemarsson, Västerås (SE); Lars Jonsson, Västerås (SE); Jan-Anders Nygren, Västerås (SE); Per Larsson, Västerås (SE)

(73) Assignee: ABB T&D Technology LTD et al., Zurich (CH)

( * ) Notice: Subject to any disclaimer, the term of this patent is extended or adjusted under 35 U.S.C. 154(b) by 0 days.

(21) Appl. No.: 09/959,667

(22) PCT Filed: May 2, 2000

(86) PCT No.: PCT/SE00/00835

§ 371 (c)(1),
(2), (4) Date: Feb. 26, 2002

(87) PCT Pub. No.: WO00/67271

PCT Pub. Date: Nov. 9, 2000

(30) Foreign Application Priority Data

May 3, 1999 (SE) ..... 9901627

(51) Int. Cl.[7] ..... H01H 53/00
(52) U.S. Cl. ..... 335/147; 335/16
(58) Field of Search ..... 335/6, 16, 147, 335/174

(56) References Cited

U.S. PATENT DOCUMENTS

| | | | | |
|---|---|---|---|---|
| 2,951,188 A | | 8/1960 | Diebold | |
| 2,971,130 A | | 2/1961 | Diebold | |
| 5,059,932 A | * | 10/1991 | Bonhomme | 218/48 |

FOREIGN PATENT DOCUMENTS

| | | |
|---|---|---|
| EP | 0147036 | 7/1985 |
| FR | 2493031 | 4/1982 |

* cited by examiner

*Primary Examiner*—Ramon M. Barrera
(74) *Attorney, Agent, or Firm*—Dykema Gossett PLLC

(57) ABSTRACT

An electric switching device for fast closing of a high current in a power network comprising a first electrode (1), a second electrode (2), a movable contact element (3) closing said first and second electrodes, and an operating device. The operating device comprises a helically wound first coil (6) secured to the first electrode. The movable contact element comprises a flange (4) making contact with the coil. A current pulse flowing through the coil forms a repulsive force between the coil and the flange, said repulsive force throwing the movable contact element to the second electrode and completing the closing operation.

8 Claims, 2 Drawing Sheets

ELECTRIC SWITCHING DEVICE

TECHNICAL FIELD

The present invention relates to an electric switching device for high current in an electrical power network. More particularly, the invention relates to a so-called high-speed circuit closer which is adapted to achieve a fast mechanical electric short circuit of at least one phase in a multi-phase network. The switching device is preferably intended to be used as arc eliminator in cubicle-enclosed switchgear in distribution networks and in transmission networks. Thus, the invention comprises both low, medium and high voltage. In accordance with the IEC standard, medium voltage means 1-72.5 kV whereas high voltage is >72,5 kV.

BACKGROUND ART

In arcs, caused by large fault currents, very large amounts of energy are released in the form of heat and radiation. In, for example, enclosed switchgear, with its limited space, these amounts of energy give rise to increases in pressure which may blast the enclosure. Such switchgear must therefore be equipped with space-demanding relief openings through which the heated gases are given a possibility to flow out. Further, the high arc temperatures cause the material in conductors and in switching equipment to melt and even evaporate. Burnable organic material may also be ignited when subjected to the high temperature and intense radiation of the arc. By decomposition of air (NOx) and evaporation of metals, the arc gives rise to poisonous gases. It is, therefore, common for such switchgear to be provided with devices for pressure relief in the form of evacuating channels, automatically openable hatches, etc. This means that such switchgear will be bulky and costly.

In industry, there has long been a great need to primarily prevent arcs from arising. In the second place, there has been a need to minimize the arc duration. In this way, material damage as a result of the heat and the pressure increase, built up during the duration of the arc, can be reduced. Also, the risk of personal injury and poisoning is reduced.

In case of a duration of the arc of about 30 ms, a switch-gear unit may be completely blown out. The pressure wave caused by the arc usually reaches its maximum even after 10–25 ms. To reduce the material damage, there is thus a need to limit the arc duration to about 10 ms. To reduce the risk of personal injury, still shorter arc durations should be aimed at. However, known circuit breakers have a considerably longer break-time. One common way of limiting the duration of the arc is, therefore, to rapidly switch the fault current to ground before the actual breaking operation.

A common problem in connection with a closer is that burns arise on the contact surfaces. Immediately before the switching elements come into contact with each other, arcs arise which partially melt the metal in the contact elements. This deteriorates the contact and causes development of heat. Known closers must therefore be overhauled at short intervals.

From, for example, DE-A-2623816, it is previously known to use, in gas-insulated, metal-enclosed switchgear, a fast grounding switch to extinguish a short-circuit arc between a high-voltage conductor and the grounded enclosure, to thus eliminate the risk of a dangerous overpressure building up. The grounding switch described in the publication is of single-phase design and is operated by a built-in explosive charge, the ignition of which is initiated by a sensor actuated by the arc. One disadvantage with such a grounding switch is that it must undergo a general overhaul or be replaced after one single operation. A further disadvantage is the handling and storage of explosives during such an overhaul.

From WO 97/45851, a high-speed circuit closer is previously known which, with a torsion-sprung contact device, brings a knife-shaped contact part into contact with a fork-shaped contact part. Both contact parts are housed in a container with insulating gas. The task of the known high-speed circuit closer is to achieve a rapid closing and prevent burns from arising on the contact parts. One disadvantage with this high-speed circuit closer is that a relatively large number of parts are included in the actual movement. The composition of the breaker is also relatively complicated. For optimum function, the torsion spring has to be adjusted carefully. A further disadvantage is that the closer only functions as a closer. Thus, it requires manual return to the insulating position. The spring must then be tensioned to be put into operational condition again.

SUMMARY OF THE INVENTION

The object of the present invention is to suggest ways and means of achieving a fast electric switching device, the break-time or make-time of which is less than about 5 ms. In its function as a grounding switch, a so-called arc eliminator, it shall prevent the occurrence of arcs at the moment of contact so as to avoid damage to the contact elements. It shall effectively brake the movable contact system during a closing operation. The switching device shall be able to carry out several closing and opening operations in rapid succession, also in the reverse order. The switching device shall manage both a high voltage and a high current. It shall have a simple and compact design which makes possible installation in conventional air-insulated switchgear without the above-mentioned disadvantages which are associated with prior art designs.

These objects are achieved according to the invention by an electric switching device according to the characteristic features described in the characterizing portions of the independent claims 1 and 6 and by a method according to the characteristic features described in the characterizing portions of the independent method claims 7 and 8. Advantageous embodiments are described in the characterizing portions of the dependent claims.

In high-voltage switchgear, grounding switches of two kinds are used, namely, working grounding switches and high-speed grounding switches. From a first aspect of the invention, the switching device is adapted to constitute a grounding switch of the latter kind. Such a fast grounding switch, a high-speed grounding switch, shall manage to ground the high-voltage parts also when these are energized and in case of large fault currents. In such a switching case, the contacts are subjected to full short-circuit current. In order thus to limit the contact burn-off and other function-reducing effects which are caused by the arcs which are usually created during the closing operation, bouncing movements between the contacts must be limited or completely eliminated. The bouncing movements are primarily dependent on the speed at which the contact parts butt against each other. The amplitude of the bouncing movement thus increases with the relative final speed between the contact parts. An important task of the high-speed circuit closer is therefore to achieve a low speed of the contacts at the moment of closing and an ability to damp the kinetic energy of the contacts.

From a second aspect of the invention, the electric switching device is adapted to constitute a circuit breaker. Usually, a circuit breaker must be able to handle the occurrence of an arc between the contacts. To this end, a conventional circuit breaker is equipped with means for extinguishing an arc thus arisen. However, the switching device according to the invention is so fast that no significant amount of energy has time to build up in the arc. The arc therefore expires by rapid separation of the contacts during zero crossing in the current.

The switching device according to the invention is arranged with a first contact part, a second contact part and a movable contact part displaceable therebetween. In the open position, the movable contact part rests at the first contact part. In the closed position, the movable contact part rests in contact with both the first contact part and the second contact part, whereby the current is passed through the movable contact part. In a first stage of the closing or opening movement, a rapid acceleration is imparted to the movable contact part. In a subsequent stage, the movable contact part moves at constant speed. In a conventional arc eliminator, a movable contact part usually moves under continuous acceleration during the whole movement, whereby a high speed of the movable contact part is achieved at the moment of closing. In a switching device according to the invention, where the movement is divided into an acceleration phase and a phase with a constant speed, a lower speed of the movable contact is obtained, for the same make-time, at the moment of closing.

The accelerating movement of the movable contact part is achieved with a so-called Thomson coil. When a current pulse traverses a flat-wound helical coil, the coil forms a variable magnetic field. In an adjacent metallic object, eddy currents are formed which, in turn, create a variable magnetic field directed in the opposite direction. For large current pulses, a strong repulsive force is formed between the coil and the adjacent metallic object. However, the force decreases rapidly with the distance. According to the invention, the movable contact part is designed as a sleeve of metal with a flange arranged at one end. The sleeve surrounds the first contact part and is arranged, in its open position of rest, such that the flange makes contact with a helical, flat coil arranged around the first contact part. When a current pulse traverses the coil, a strong repulsive force is thus formed between the coil and the flange, which force pushes away the sleeve against the second contact part.

For the breaking movement of the switching device, a Thomson coil is arranged in a similar manner. Secured to a housing of insulating material, surrounding the contacts, a helically wound flat coil is arranged. Spring-loaded against this coil, a metallic ring surrounding the sleeve is arranged. When a current pulse traverses the coil, a repulsive force arises which pushes the ring in a direction away from the second contact part. The ring and the flange of the sleeve are arranged such that the ring hits the flange. Upon this contact, the ring transfers its kinetic energy to the flanged sleeve, causing the sleeve to resume its open position of rest.

Between two poles with different potential, an electric field arises. The appearance of this field is largely dependent on the shape of the electrodes. If the electrodes are pointed or contain edges or irregularities, concentrations in the electric field arise. Such concentrations in the field may give rise to partial discharges. These discharges may, in turn, be the embryo of arcs. The switching device according to the invention is arranged with round electrodes, whereby concentrations in the electric field are avoided. As a result thereof, it has been possible to reduce the distance between the electrodes in case of full insulation. A smaller distance gives less energy requirement for moving a contact element which brings about contact between the electrodes. Due to the smaller distance it also takes less time to bring about contact. At high voltages, the contacts are arranged enclosed in a container filled with insulating gas, the insulating gas being utilized to further reduce the distance between the contact parts.

When two contacts approach each other, a small arc arises at the moment of contact. This is dependent on the current but also on the bouncing movement which arises between the contacts during the impact. The energy which causes these movements is dependent on the speed squared. This means that a reduction of the speed is exceedingly favourable for reducing the occurrence of bouncing movements. In case of a sliding contact, where the contact parts are moving in parallel with the contact surface, bouncing effects also occur in that a transverse force is imparted, upon impact, to the contact parts, which force sets the contact parts in oscillation. The oscillation causes the contact parts to alternately be in contact with each other and alternately be at a distance from each other. During the short time during which the contact parts are separated from each other, an arc arises which causes damage to the contact surfaces.

According to the invention, the harmful arcs are eliminated by means of a plurality of spring fingers. These are made of a conducting material with a high mechanical yield point. The spring fingers are placed in contact with the second contact part and are adapted, upon oscillation, to exhibit a high mechanical resonant frequency. When the movable contact part is brought to rapidly slide against the second contact part, it first hits the contact fingers, which are thrown sideways. By this force, the spring fingers are set into oscillation such that a bouncing movement arises. The spring fingers are dimensioned to obtain a high resonant frequency. On its way, the movable contact part knocks against a plurality of fingers, which are all brought into oscillation. The spring fingers are struck at different times and have different resonant frequency. This means that the phase difference between the oscillation of the different fingers will be random. Since the oscillation frequency is high, some finger will always be in contact with the movable contact part. This means that arcs do not arise and when the movable contact part has assumed the closed position, also the vibration of the contact fingers has decreased, enabling the grounding switch to carry the current, As contact-making member between each of the first and the second contact part and the movable contact part, one or a plurality of tapes of helically wound wire are used. In conventional switching devices, this type of contact member occurs at the corresponding contact between the first contact part and the movable contact part. However, it is not known to arrange such a contact member for providing contact between correspondingly the second contact part and the movable contact part. Thus, conventional switching devices exhibit a fixed contact part, corresponding to the second contact part, which has contact fingers.

BRIEF DESCRIPTION OF THE DRAWINGS

The invention will be explained in greater detail by description of an embodiment with reference to the accompanying drawing, wherein.

DESCRIPTION OF THE PREFERRED EMBODIMENTS

Figure 1:
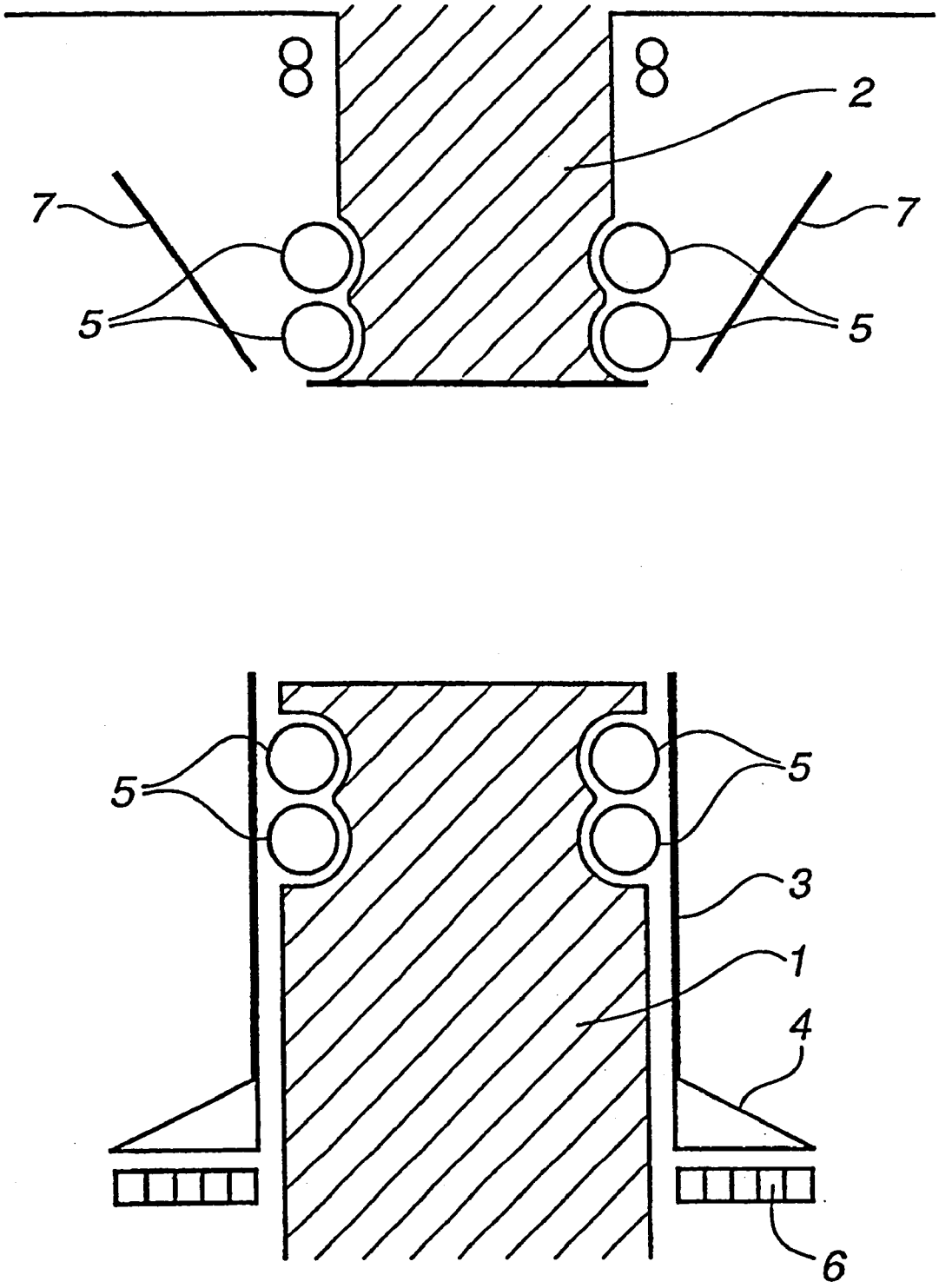
FIG. 1 shows an explanatory sketch of a switching device with two fixed and one movable contact part according to the invention.

A switching device according to the invention includes a first contact part 1, a second contact part 2 and a movable contact part 3. The movable contact part is formed as a sleeve. The sleeve surrounds the first contact part and is formed with a flange 4. Between the first and second contact parts, respectively, and the movable contact part, contact members 5 are arranged. In the embodiment shown, these contact members are designed in the form of tapes of helically wound wire. The tapes surround the first and second contact part, respectively, and are arranged in grooves in the respective contact part. The helically wound shape permits the tapes to make contact with a resilient force with the respective contact part. The contact members are adapted to allow the movable contact part a longitudinal movement with a retained low-ohmic contact with each of the first and the second contact part, respectively.

A first helical coil 6, a so-called Thomson coil, is arranged adjacent to the flange 4. In the figure, the helical coil is arranged immediately below the flange, the flange being adapted to make contact with the coil. When a current pulse flows through the coil from a current source (not shown), a variable magnetic field arises, which induces eddy currents in the flange 4. The eddy currents, in turn, give rise to the formation of a magnetic field directed opposite to the first magnetic field. This gives rise to a strong repulsive force which throws away the flanged sleeve 3 against the second contact part.

A plurality of arc fingers 7 of spring steel are arranged around the second contact part. These arc fingers are clamped into contact with the second contact part, in the upper part of the figure, and have their free ends, the fingertips, directed obliquely to the first contact part. The arc fingers are adapted to exhibit a deflection with a high resonant frequency. When the fingers are hit by the forward-moving movable contact part, a vibrating movement thereof arises. The fingertips then bounce against the movable contact part. Each time the fingertip leaves the surface of the movable contact part, a small arc arises. However, since a plurality of fingers are arranged around the second contact part and all lie in different phases and have different resonant frequencies, at all time always some fingertip is in contact with the movable contact part. This causes these arcs to be eliminated.

Figure 2:
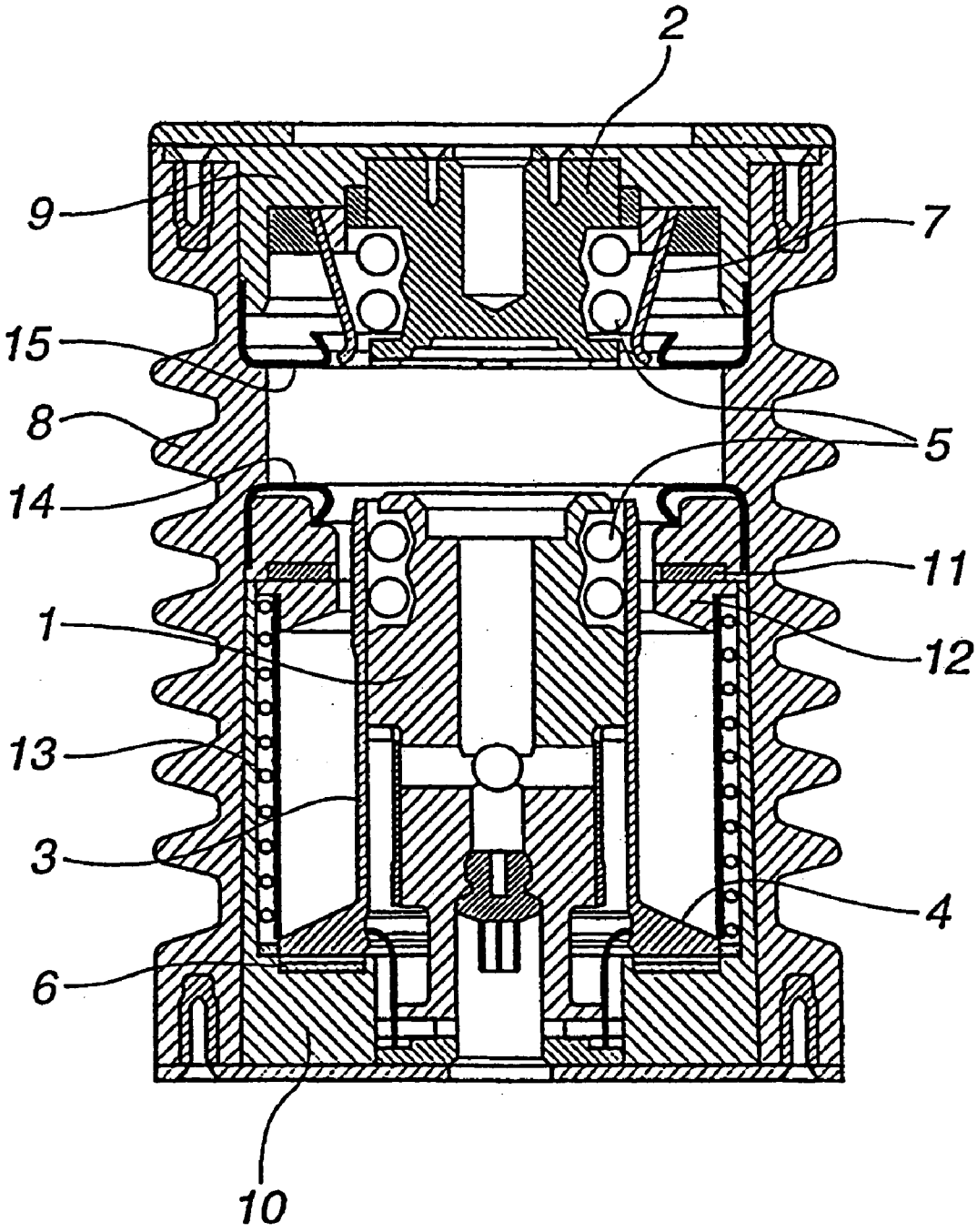
FIG. 2 shows an advantageous embodiment of the switching device, comprising a device for achieving breaking.

FIG. 2 shows an advantageous embodiment of a switching device according to the invention. The embodiment comprises all the previously mentioned parts which are indicated by the same reference numerals. In the example shown, the contacts are arranged in an enclosure of an insulating material. The enclosure, which suitably is filled with a protective gas, consists, according to the example shown, of a cylindrical wall 8, a top part 9 and a bottom part 10.

Upon a closing operation, the movable contact part is thrown against the second contact part such that, in the closing position, this contact part brings about contact with the first contact part and the second contact part. This is done with the aid of the contact members 5. In the closing position, the flange 4 makes contact with a hammer ring 12, which in turn makes contact with a second helical coil 11. The hammer ring is movable along the extent of the movable contact part and is maintained in contact with the second helical coil by the force from a spring 13. The second helical coil is secured to the bottom part 10. When a current pulse from a current source (not shown) flows through the second helical coil, a variable magnetic field arises, which induces eddy currents in the hammer ring 12. The eddy currents, in turn, give rise to the formation of a magnetic field directed opposite to the first magnetic field. This gives rise to a strong repulsive force which throws away the hammer ring against the flange of the movable contact part. The kinetic energy thus established is transferred to the flange of the movable contact part which is thrown to its open position of rest. If, for some reason, the movable contact part should not have completely reached the closed position, the hammer ring will transfer the kinetic energy to the movable contact through an impulse. The solution shown for the breaking function is thus independent of whether the preceding closing operation has been complete.

A shield ring 14 is arranged on a level with that end of the first contact end which faces the second contact part. In a corresponding way, a shield ring 15 is arranged on a level with that end of the second contact part which faces the first contact part. The two shield rings are adapted to distribute the electric field occurring between the first contact part and the second contact part, such that no field concentrations arise.

What is claimed is:

1. An electric switching device for fast closing of a high current in a power network comprising a first plug-shaped electrode, a second plug-shaped electrode, a movable contact element for closing said first and second electrodes, and an operating device, wherein the contact element is cylinder-shaped and surrounds the first electrode in an open position of the switching device, the operating device comprises a helically wound first coil secured to the first electrode, and the contact element comprises a flange making contact with the coil, a current pulse flowing through the coil forming a repulsive force between the coil and the flange, said repulsive force throwing the movable contact element to the second electrode, whereby, in a closed position of the switching device, the contact element surrounds both the first electrode and the second electrode.

2. A switching device according to claim 1, wherein between the second electrode and the movable contact element in the closed position, there are arranged contact members comprising helically wound, conducting wire.

3. A switching device according to claim 1, wherein a plurality of arc fingers of spring steel are arranged at the second electrode, said arc fingers being adapted to prevent the occurrence of arcs between the second electrode and the movable contact element.

4. A switching device according to claim 1, wherein a first shield is arranged at the first electrode and a second shield is arranged at the second electrode, the first and second shields being adapted to distribute between them the electric field.

5. A switching device according to claim 1, wherein a hammer ring, displaceable along a longitudinal direction of the movable contact element, is arranged making contact with a secured second helical coil, a current pulse flowing through the coil forming a repulsive force between the coil and the hammer ring, which repulsive force throws the hammer ring against the flange of the movable contact element, whereby kinetic energy is obtained and is transferred to the movable contact element which returns to the original position.

6. An electric switching device for fast breaking of a high current in a power network comprising a first plug-shaped electrode, a second plug-shaped electrode, a movable contact element for closing said first and second electrodes, and an operating device, wherein the movable contact element is cylinder-shaped and surrounds both the first electrode and the second electrode in a closed position of the switching device, said operating device comprises a helically wound coil and a hammer ring making contact with the coil and being displaceable along the movable contact element, and the movable contact element comprises a flange for receiving contact with the hammer ring, a current pulse flowing through the coil forming a repulsive force between the coil and the hammer ring, said repulsive force throwing the hammer ring against the movable contact element, whereby transferred kinetic energy causes the contact element to assume an open position of the switching device.

7. A method for fast closing of a high current in a power network comprising a second plug-shaped electrode which is brought into contact with a first plug-shaped electrode by a movable contact element, wherein the movable contact element is cylinder-shaped, the contact element in an open position of the switching device is adapted to surround the first electrode, the contact element comprises a flange which is brought to make contact with a helically wound coil secured to the first electrode, and the coil is brought to be traversed by a current pulse such that a repulsive force between the coil and the flange is formed, whereby the movable contact element is thrown to the second electrode, whereupon both the first electrode and the second electrode are surrounded by the contact element.

8. A method for fast breaking of a high current in a power network wherein a movable contact element, which brings about contact between a first plug-shaped electrode and a second plug-shaped electrode, is brought to he displaced from the second electrode to the first electrode such that breaking arises, wherein the movable contact element is arranged cylinder-shaped and surrounding both the first and the second electrode in a closed position of the switching device, the contact element comprises a flange, a hammer ring, which is displaceable along the movable contact element, is adapted to make contact with a helically wound coil, and the coil is brought to be traversed by a current pulse, whereby a repulsive force between the coil and the hammer ring is formed, whereby the hammer ring is thrown against the flange of the movable contact element, whereby a kinetic energy is transferred to the contact element which brings the contact element to assume an open position of the switch device.

* * * * *